US006928835B1

(12) United States Patent
Cousin et al.

(10) Patent No.: US 6,928,835 B1
(45) Date of Patent: Aug. 16, 2005

(54) POP BEADS HAVING ELONGATED NECKS

(76) Inventors: Michael G. Cousin, 12433 84th Way North, Largo, FL (US) 33773; Jeffrey Cousin, 2383 Flintlock Dr., Clearwater, FL (US) 34625; Michelle Marcott, 709 7th St. SE., Largo, FL (US) 33771; Deborah Campbell, 342 Barbara Cir., Belleair, FL (US) 33756; Mark Pezzuti, 2270 Beverly La., Clearwater, FL (US) 34624; John Johnston, 6585 48th Ave. N., St. Petersburg, FL (US) 33709

( * ) Notice: Subject to any disclaimer, the term of this patent is extended or adjusted under 35 U.S.C. 154(b) by 252 days.

(21) Appl. No.: 10/063,088

(22) Filed: Mar. 18, 2002

Related U.S. Application Data

(63) Continuation-in-part of application No. 09/452,732, filed on Dec. 1, 1999, now Pat. No. 6,401,488.

(51) Int. Cl.[7] ..... A44C 25/00

(52) U.S. Cl. ..... 63/39; 63/38; 63/3.1; 63/3.2; 63/DIG. 3; 59/2; 446/120; 434/171

(58) Field of Search ..... 63/DIG. 3, 1.11, 63/1.16, 3.1, 3.2, 4, 29.1, 38, 39; 59/2; 446/120, 121, 106, 102; 434/171

(56) References Cited

U.S. PATENT DOCUMENTS 2,714,269 A * 8/1955 Stafford ..... 59/80
3,066,501 A * 12/1962 Stafford et al. ..... 63/39
4,044,725 A * 8/1977 Miller ..... 119/865
4,406,296 A * 9/1983 Wexler et al. ..... 132/148
5,138,855 A * 8/1992 Faris ..... 70/457
6,401,488 B1 * 6/2002 Cousin et al. ..... 63/3

FOREIGN PATENT DOCUMENTS

CH 631 608 * 8/1982
GB 2111372 A * 7/1983 ..... A01N/11/00

OTHER PUBLICATIONS

Linder, "Kinds of Fat", 2 pages, from www.agctr.1su.edu/subjects/eatsmart/fat2.htm, undated.*

* cited by examiner

*Primary Examiner*—Robert J. Sandy
*Assistant Examiner*—Katherine Mitchel
(74) *Attorney, Agent, or Firm*—Ronald E. Smith; Smith & Hopen, P.A.

(57) ABSTRACT

Jewelry items such as rings, bracelets and necklaces are made of pop beads of novel construction. The structure includes a spherical body from which extends an elongate, flexible neck having a ball formed on its distal free end. The neck is sufficiently long to enable it to be formed into a loop so that it can be press fit into a socket formed on the opposite side of the same spherical body, and the neck is adapted to receive a plurality of strung beads. In a second embodiment, the neck is not long enough to enable it to be formed into a loop, but is sufficiently long to receive at least on strung bead so that Jewelry items are made by connecting a plurality of the pop beads together with strung beads being positioned between the respective spherical of the pop beads.

1 Claim, 5 Drawing Sheets

POP BEADS HAVING ELONGATED NECKS

This application is a Continuation-in-Part of Ser. No. 09/452732, filed Dec. 1, 1999 now U.S. Pat. No. 6,401,488.

BACKGROUND OF INVENTION

1. Field of the invention

This Invention relates, generally, to decorative jewelry. More particularly, it relates to plastic beads having ball and socket connection means.

2. Description of the prior art

A typical bead of the type used to make jewelry items such as rings, bracelets, necklaces, and the like has a socket formed in a first hemisphere thereof and a mating ball formed on a diametrically opposite side thereof. More particularly, the ball is formed on the free end of a truncate, radially-extending neck. Accordingly, it is easy to connect two beads together by inserting the ball of a first bead into the socket of a second bead. That process is continued to build a ring, bracelet, necklace, belt, or the like.

The socket has a cavity for receiving the ball that is slightly larger than the ball. However, the opening of the cavity has a breadth slightly less than the breadth of the ball so that some pressure must be applied to urge the ball through the opening. The opening of the cavity is momentarily enlarged as the ball is pushed into the cavity, but due to the resilience of the flexible and resilient material of which the bead is made (preferably plastic), the opening returns to its initial diameter after the ball has entered the cavity, retaining it therein. The procedure is reversed to disconnect contiguous beads from one another. When a ball is pulled out or pushed into its cavity, a "pop" sound is generated, giving beads of this type their well-known name.

The primary drawback of these beads is that the jewelry items made by connecting them together have a very uniform appearance. Regardless of whether the jewelry item is a bracelet or a necklace, for example, it will contain many pop beads of the same size, all spaced the same distance apart from their contiguous beads.

Another shortcoming is that pop beads cannot be used in conjunction with other types of beads. For example, people also enjoy making jewelry items from strung beads, but that type of bead cannot be used with pop beads. A strung bead has a throughbore formed therein coincident with its diameter, and large numbers of them are strung onto a string to form a bracelet, necklace, or the like when the opposite ends of the string are tied to one another. If the string breaks or becomes untied, the strung beads spill onto the ground or floor and it is a very-time-consuming task to retrieve them. Due to the attractiveness of strung beads, they remain a popular item even with their drawbacks.

Accordingly, there is a need for an improvement in pop beads. The improved beads should allow a person to create jewelry items not restricted to strings of pop beads.

Additionally, there is a need for an improvement in strung beads. A means is needed that would reduce the spillage problem associated with broken or untied strings.

Moreover, it would also be highly advantageous if a means could be found for uniting pop beads and strung beads in the construction of bracelets, necklaces, and the like.

However, it was not obvious to those of ordinary skill in this art how the needed improvements could be provided, in view of the art considered as a whole at the time the present invention was made.

SUMMARY OF INVENTION

The long-standing but heretofore unfulfilled need for an innovation that overcomes the limitations of the prior art is now met by a new, useful, and nonobvious invention. The present invention includes a novel pop bead construction. Each pop bead includes a spherical body. An elongate, flexible neck is formed on the spherical body and extends radially therefrom. A ball is formed on a distal free end of the elongate, flexible neck. A socket is formed in the spherical body on the surface thereof opposite the elongate, flexible neck and includes a cavity and an opening into the cavity. The opening is formed on a surface of the spherical body in diametrically opposed relation to the elongate, flexible neck, and has a breadth slightly less than a breadth of the ball. The spherical body is formed of a flexible and resilient material so that the opening momentarily enlarges to admit the ball into the cavity when the ball is pressed thereinto and the opening returns to its initial breadth to capture the ball in the cavity after the ball has passed through the opening. The opening also momentarily enlarges and returns to its initial breadth when the ball is removed therefrom by a pulling action.

The elongate, flexible neck has a predetermined length sufficient to enable a ball formed on a distal end thereof to be inserted into a socket formed in the same spherical body from which the elongate, flexible neck extends. When so inserted, the elongate, flexible neck forms a loop or circle, beginning in a first hemisphere of the spherical body and ending in the second hemisphere thereof in diametric opposition to the beginning thereof. In this way, a jewelry item of generally annular construction such as a ring, bracelet, necklace, belt or the like is constructed from a single pop bead.

A plurality of strung beads may be disposed in engaging relation to the elongate, flexible neck. Each strung bead of said plurality of strung beads has a diametrically-extending throughbore formed therein and the throughbore has a diameter greater than a diameter of the ball so that the strung beads are slideably positionable onto the elongate, flexible neck. The throughbore has a diameter less than a diameter of the spherical body so that the strung beads are captured between opposite sides of the spherical body when the ball is positioned within the socket.

In a second embodiment, the elongate, flexible neck is substantially shorter than in the first embodiment in that said neck is not sufficiently long to enable the formation of a loop or circle where a ball formed in the distal end of the neck is able to engage a socket formed in the same spherical body. However, it is still substantially longer than pop bead necks of the prior art and, accordingly, is capable of providing a mounting means for a plurality of strung beads to obviate the problems associated with mounting said beads on strings.

Although a jewelry item cannot be made from a single pop bead of this second type, unique jewelry items can be made by linking a number of these relatively truncate neck pop beads to one another. Prior to insertion of a ball into the socket of an adjacent bead, however, strung beads are strung onto the relatively truncate neck. Thus, when a bracelet, necklace or the like has been assembled in this fashion, the resulting structure has pop beads that are spaced apart from one another by strung beads. This combines the respective aesthetic appeals of pop and strung beads and also provides a more secure mounting for the strung beads than heretofore known.

The invention further contemplates using the aesthetic appeal of pop beads and strung beads in combination to decorate common items such as barrettes. In a third embodiment of the invention, a chain of the novel pop beads having relatively truncate necks and having strung beads strung onto said truncate necks is made and attached to various items in depending relation thereto. For example, a barrette, an eyeglass holder, and a lanyard hook are modified to include an aperture to capture a pop bead ball so that a chain formed of the novel pop bead and string beads may depend therefrom. Alternatively, the barrette, eyeglass holder, and lanyard hook may have a truncate neck and ball depending therefrom to which is attached a chain of the novel pop beads and strung beads.

However, this embodiment of the invention is not restricted to barrettes, eyeglass holders, and lanyard hooks. The inventive idea is applicable to numerous other articles such as brooches, pins, hats and other articles that may be worn as accessories. An opening is formed in a preselected article at a preselected location. The opening has a breadth slightly smaller than a ball formed on a distal free end of a neck that extends radially from a spherical body of a first pop bead. The article is formed of a flexible and resilient material so that the opening is adapted to expand momentarily when the ball passes therethrough and is adapted to return to a position of repose after the ball has passed therethrough so that the ball is captured. The opening is formed in the article at a lowermost end thereof so that the first pop bead and any further pop beads attached thereto depend therefrom. Alternatively, the opening is replaced by a neck having a ball formed in its distal end, and a socket formed in a first pop bead receives said ball.

In a fourth embodiment, a pop bead construction is provided for linking together a plurality of base members, where the base members may be letters of the English alphabet, the alphabet of another language, a character from a non-alphabetic language, or any other symbol. A first elongate neck extends from a first side of a first base member at an upper end thereof and a ball is formed in a distal free end of the first elongate neck. A second elongate neck extends from a second side of the first base member at an upper end thereof and a spherical member is formed on the second elongate neck at a distal free end thereof. A socket is formed in the spherical member and is adapted to releasably receive a ball of a second base member therewithin. Each of the base members is formed in the shape of a symbol so that a chain of symbols is formed when a ball of a first base member engages a socket of a contiguous spherical member. The elongate neck and socket are preferably formed in the respective base members at an upper end thereof so that the base members substantially depend from respective innermost ends of the first and second elongate necks of each base member.

A major object of this invention is to provide a pop bead having a flexible, elongate neck that has a length sufficient to enable it to be formed into a loop so that a ball at the distal free end of the neck may be releasably engaged to a socket formed in the same pop bead.

It is also an important object of this invention to provide pop beads having the ability to be combined with other jewelry building blocks.

A more specific object is to provide a means for combining pop beads and strung beads into a single jewelry item.

Another object is to enable people to enjoy enhanced levels of creativity when creating with pop beads and strung beads.

Still another object is to provide a better mounting means for strung beads.

These and other important objects, features, and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF DRAWINGS

For a fuller understanding of the nature and objects of the invention, reference should be made to the following detailed description, taken in connection with the accompanying drawings, in which.

DETAILED DESCRIPTION

Figure 1:
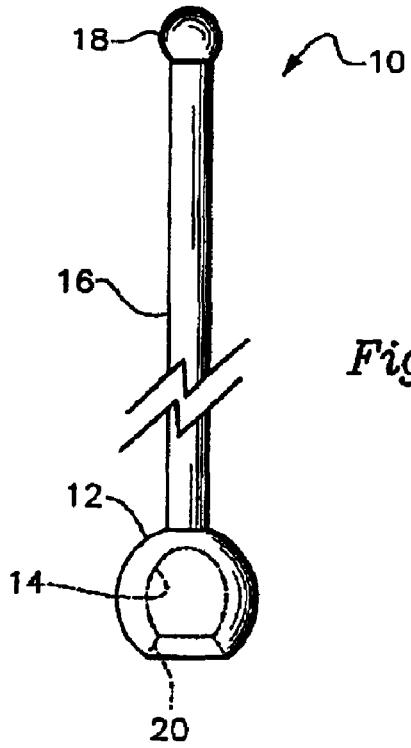
FIG. 1 is a side elevational view of a novel pop bead when in repose.

Referring now to FIG. 1, it will there be seen that an exemplary embodiment of the invention is denoted as a whole by the reference numeral 10.

Spherical body 12 is preferably formed of an opaque material and includes cavity 14 formed therein on a first side or hemisphere thereof and an elongate, flexible neck 16 formed on a diametrically opposite side thereof. Ball 18 is formed in the free end of elongate, flexible neck 16 and has a breadth slightly less than that of cavity 14. Opening 20 of cavity 14 has a breadth slightly less than that of ball 18 but spherical body 12 is formed of a flexible and resilient, relatively hard plastic so said opening momentarily enlarges when ball 18 is pressed into cavity 14, and said opening then returns to its position of repose so that ball 18 is captured within said cavity. The ball 18 is extracted from cavity 14 by pulling on elongate neck 16. Cavity 14 and opening 20 will be collectively referred to as socket 14. Ball 18 cannot be seen when disposed within cavity 14, unless spherical body 12 is formed of a transparent or translucent material.

Figure 2:
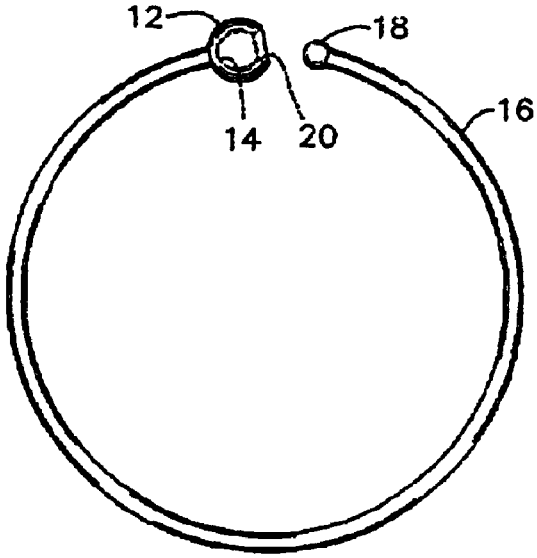
FIG. 2 is a side elevational view of the pop bead of FIG. 1 when its elongate, flexible neck has been flexed to enable the ball thereof to be received within the socket of the same pop bead.

As depicted in FIG. 2, the provision of flexible elongate neck 16 enables it to be formed into a circle or annular ring so that ball 18 can be pressed into socket 14. Depending upon the length of elongate, flexible neck 16, the structure depicted in FIG. 2 may serve as a ring, a bracelet, a necklace, or even a belt. This is unlike any pop bead heretofore known because earlier pop bead rings, necklaces, and the like require that a string of pop beads be pressed together when it is desired to construct an elongate jewelry item. This invention thus enables the making of a jewelry item with a single pop bead. The minimum length of elongate, flexible neck 16 is therefore defined as that minimum length that enables a ball of a pop bead to be inserted into the socket of the same pop bead.

Figure 3:
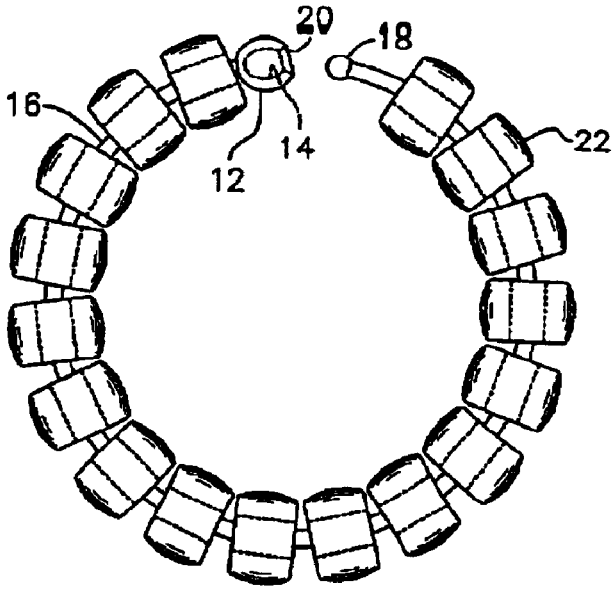
FIG. 3 is a view like that of FIG. 2, but further depicting a plurality of strung beads connected to the elongate, flexible neck.

FIG. 3 depicts yet another advantage of elongate, flexible neck 16. A plurality of decorative strung beads, collectively denoted 22, is attached to elongate, flexible neck 16 to create a unique jewelry item. Beads 22 are provided in multiple colors. Accordingly, they are very attractive when strung onto elongate, flexible neck 16. It was known heretofore to position beads 22 onto strings to create necklaces and the like, and such beads are therefore referred to as strung beads. Jewelry items made of strings often break, due to the inherent weakness of strings and the ease with which strings come untied. Thus, strung beads are often spilled onto the ground or floor. It is a difficult and time-consuming chore to pick them up, due to their small size and large numbers. It also requires much time and patience to re-string them. By providing elongate, flexible neck 16, the aesthetic effect of strung beads 22 can still be enjoyed, in the absence of string breakage or untying.

Each strung bead 22 has a throughbore formed therein that has a diameter slightly greater than ball 18 so that beads 22 can be strung onto neck 18 over said ball. However, the diameter of the throughbore is less than the diameter of spherical body 12 so that the beads cannot travel over a ball 18 after it has been popped into a socket 14.

Figure 4A:
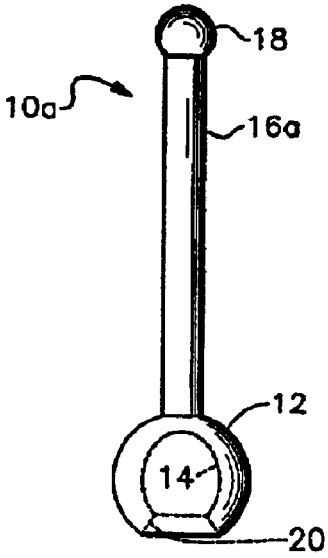
FIG. 4A is a side elevational view of a second embodiment of the novel pop bead, having a neck that is truncate in length relative to the neck length of the pop bead depicted in FIGS. 1–3.

FIG. 4A depicts a second embodiment 10*a* of the novel pop bead. It has a truncate neck 16*a* having a length insufficient to enable it to be looped over so that ball 18 formed in the end thereof can be popped into a socket 14 on the opposite side of the same spherical body 12 from which said truncate neck 16*a* extends. Nonetheless, said truncate neck 16*a* still substantially exceeds the length of the necks of pop beads of the type heretofore known. More particularly, its length is sufficient to receive thereon a plurality of strung beads 22, as best understood in connection with FIG. 4B.

Figure 4B:
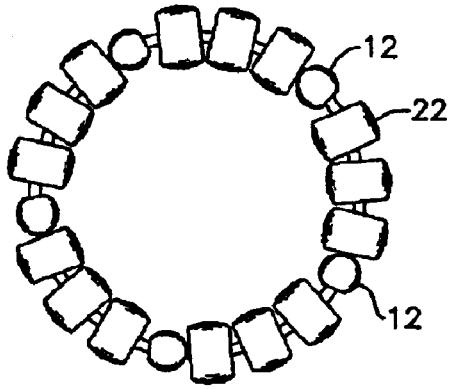
FIG. 4B is a side elevational view of a bracelet or necklace constructed by employing the pop bead of FIG. 4A in conjunction with strung beads.

FIG. 4B depicts a bracelet, necklace, or belt that incorporates the pop bead of FIG. 4A, i.e. , where the individual pop beads have necks 16*a* that are elongate relative to conventional pop beads, but which are truncate relative to neck 16 of the pop bead depicted in FIGS. 1–3. Preferably, truncate neck 16*a* has a length sufficient to receive several pop beads thereon. Accordingly, there may be a pop bead spherical body 12 after every three or four strung beads 22 as depicted in FIG. 4B. This provides an enhanced aesthetic appeal. Moreover, if a ball and socket connection is uncoupled, only a few strung beads 22 will fall to the floor or ground and require re-stringing.

Figure 5A:
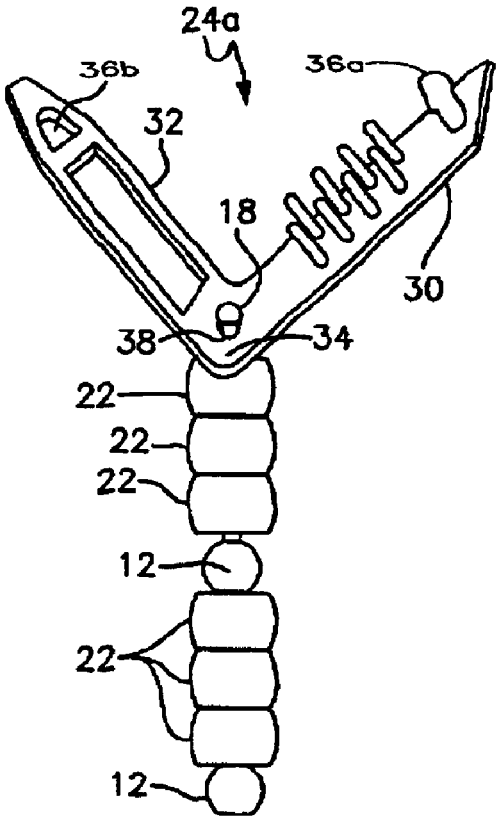
FIG. 5A is a perspective view of a novel barrette having an internal coupling means.
Figure 5B:
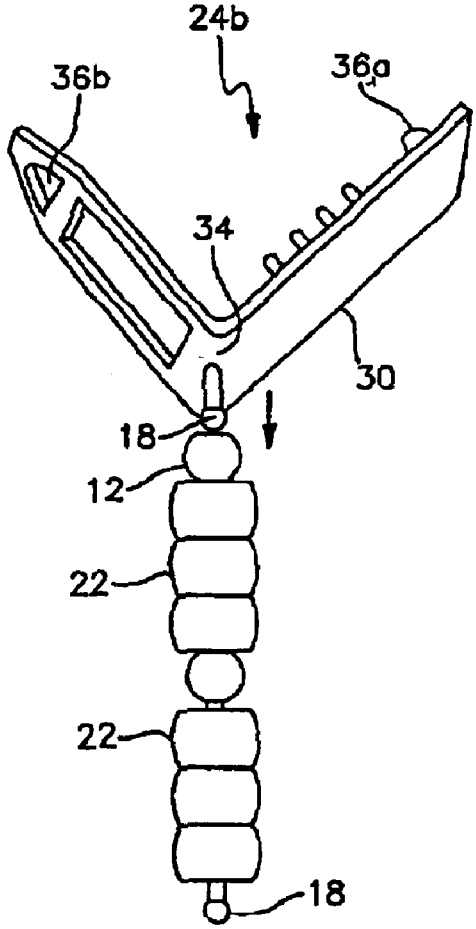
FIG. 5B is a perspective view of a novel barrette having an external coupling means.

A novel barrette 24*a*, 24*b* is depicted in FIGS. 5A and 5B, respectively. It includes a conventional base 30 and top 32 interconnected to one another by a living hinge 34, and lock means 36*a*, 36*b* of conventional construction.

In the embodiment of FIG. 5A, aperture 38 is formed in living hinge 34, centrally thereof, to receive a ball 18 of a conventional pop bead or of a novel pop bead. Aperture 38 has a diameter slightly less than the diameter of ball 18 but it is formed of a flexible and resilient material so that it expands momentarily to receive ball 18 therethrough and then returns to its position of repose, capturing ball 18.

This enables a person to decorate the barrette in the manner depicted in FIG. 5A, employing strung beads 22 strung onto the truncate necks 16*a* of the novel pop beads. A single pop bead of the type depicted in FIGS. 1–3 could be employed as well but the use of a plurality of shorter-necked pop beads is preferred for the reasons already mentioned. Moreover, a chain of conventional pop bead could be hung from aperture 38, but in such event strung beads 22 could not be used due to the insufficient length of the necks of conventional pop beads.

In the embodiment of FIG. 5B, a neck is formed integrally with hinge 34 and projects therefrom. Ball 18 is formed on the free end of the neck and provides the mounting means for a pop bead spherical body 12 having a cavity 14 (see preceding FIGS.). This enables decoration of the barrette in the manner depicted in FIG. 5B.

It should be understood that the respective embodiments of FIGS. 5A and 5B are equivalents of one another.

Figure 6A:
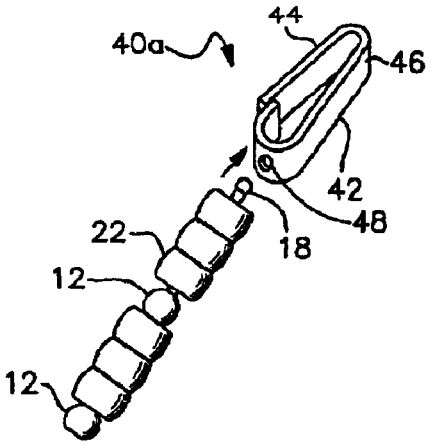
FIG. 6A is a perspective view of a novel eyeglass holder having an internal coupling means.

FIG. 6A depicts a novel eyeglass holder 40*a*. Like barrette 24, it also includes a base 42 and a top 44 interconnected to one another by a living hinge 46. Aperture 48 is formed in the return bend part of the holder opposite from living hinge 46. Aperture 48 is adapted to receive a ball 18 in the same manner as barrette aperture 38 so that an eyeglass holder may be decorated in the same way as a barrette.

Figure 6B:
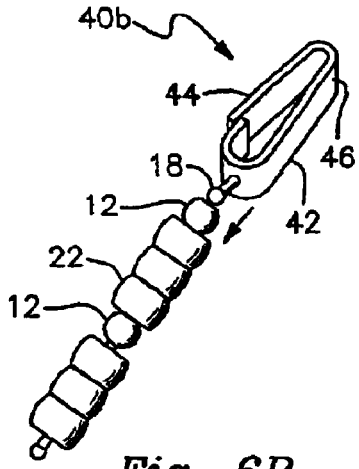
FIG. 6B is a perspective view of a novel eyeglass holder having an external coupling means.

FIG. 6B depicts a structure 40*b* that is equivalent to the structure of FIG. 6A in that aperture 48 is replaced by a neck having ball 18 formed in the distal end thereof.

Figure 7A:
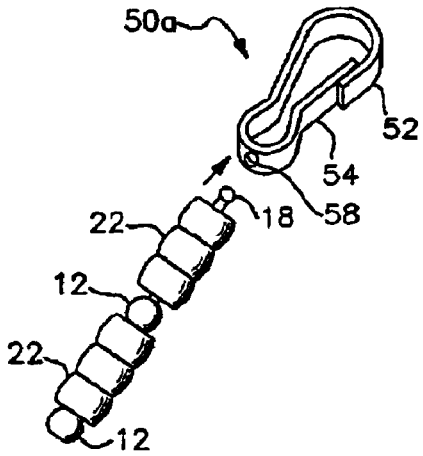
FIG. 7A is a perspective view of a novel lanyard hook having an internal coupling means.
Figure 7B:
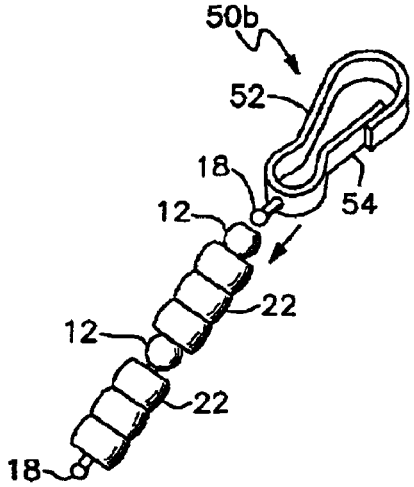
FIG. 7B is a perspective view of a novel lanyard hook having an external coupling means.

A lanyard hook 50*a*, 50*b* of the type commonly found on backpacks is depicted in FIGS. 7A and 7B, respectively. Like the barrette and eyeglass holder, it includes a base 52 and a top 54 interconnected by a living hinge in the form of a return bend. Either an aperture 58 or a neck and ball 18 may be formed in the bight of said return bend as depicted in FIGS. 7A and 7B, respectively, so that the novel pop beads and strung beads or conventional pop beads may be secured thereto in depending relation therefrom for decorative purposes.

Figure 8:
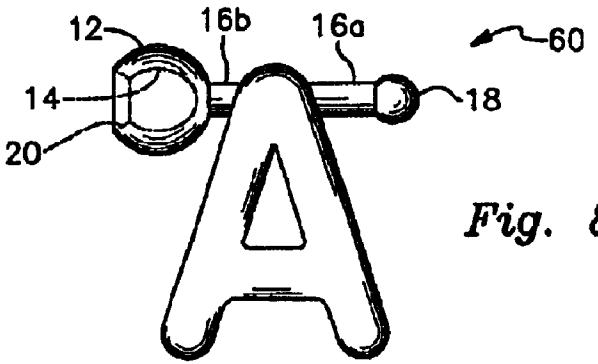
FIG. 8 is a side elevational view of a novel alphabet pop bead.
Figure 9:
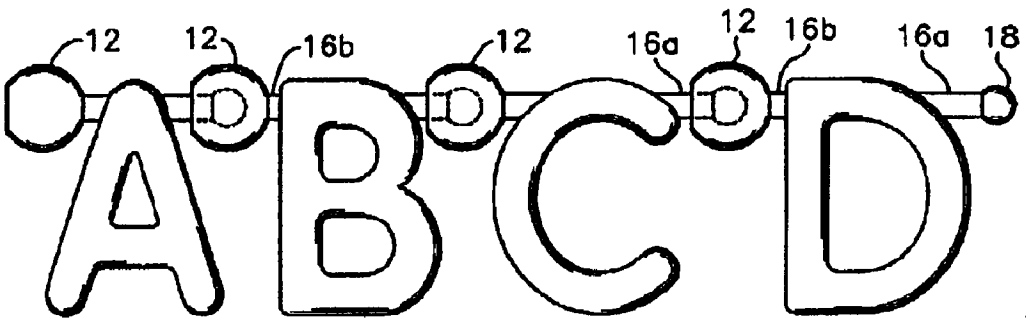
FIG. 9 is a side elevational view of a string of the pop beads of FIG. 8.

The final illustrated embodiment appears in FIGS. 8 and 9. An individual letter of the English alphabet is depicted in FIG. 8 and is denoted 60 as a whole. It includes a first truncate neck 16*a* having a ball 18 formed at the free end thereof and a second truncate neck 16*b* having a spherical body 12 with cavity 14 and opening 20 formed at the free end thereof. This novel construction enables a string of such letters to be popped together, as indicated in the example of FIG. 9. These letters may be secured in depending relation to the barrettes of FIGS. 5A and 5B, the eyeglass holders of FIGS. 6A and 6B, and the lanyard hooks of FIGS. 7A and 7B, or they may be popped together to form bracelets, necklaces, belts, chains, or the like. Letters from alphabets other than the English alphabet, and characters from non-alphabetic languages are also within the scope of this invention. Nor is the invention limited to means for interconnecting symbols associated with a written language; it also includes means for linking together symbols having no connection to any written language, such as religious, astrological, scientific, sports, and other types of symbols.

It should also be understood that this invention is not restricted to the construction of rings, bracelets, necklaces, belts, and the like, but includes any construction that uses the claimed building blocks. Moreover, the novel pop beads may be hung from anything, not just barrettes, eyeglass holders and lanyard hooks. For example, they may be hung from earrings, watches, head bands, brooches, eyeglasses, hats and other articles of clothing or accessories, and so on, that have been modified by the addition of a ball-receiving aperture or a neck and ball at an appropriate location. All of the depicted embodiments are provided for illustrative reasons, and the invention is not limited merely to the illustrated embodiments, as a matter of law. The applications of the invention are too numerous to illustrate, and the specific illustrations provided represent a disclosure of all applications to which this invention may be put.

This invention represents a major breakthrough in the arts of jewelry, pop beads, strung beads, and items from which said beads or conventional beads may depend. Being drawn to a pioneering invention, the claims that follow are entitled, as a matter of law, to broad interpretation to protect the heart or essence of the invention from piracy.

It will thus be seen that the objects set forth above, and those made apparent from the foregoing description, are efficiently attained. Since certain changes may be made in the foregoing construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

Now the invention has been described.

What is claimed is:

1. A pop bead construction for forming an annular jewelry item, comprising;

a first spherical body;

a first truncate neck formed on said first spherical body, said first truncate neck extending radially from said first spherical body;

said first truncate neck having a uniform diameter along its extent;

a first ball formed on a distal free end of said first truncate neck;

a first socket formed in said first spherical body;

said first socket including a first cavity and a first opening formed into said first cavity, said first opening formed on a surface of said first spherical body in diametrically opposed relation to said first truncate neck;

said first opening having an initial breadth slightly less than a breadth of said first ball;

said first truncate neck having a length insufficient to enable said first ball to be inserted into said first cavity;

said first truncate neck having a length sufficient to receive a first plurality of strung beads thereon;

each strung bead of said first plurality of strung beads having a bore formed therein, and each of said bores having a uniform diameter slightly greater than said uniform diameter of said fist truncate neck;

a second spherical body;

a second truncate neck formed on said second spherical body, said second truncate neck extending radially from said second spherical body;

said second truncate neck having a uniform diameter along its extent;

a second bail formed on a distal fee end of said second truncate neck;

a second socket formed in said second spherical body;

said second socket formed in said second spherical body including a second cavity and a second opening formed in said cavity, said second opening formed on a surface of said second spherical body in diametrically opposed relation to said second truncate neck;

said second opening having an initial breadth slightly less than a breadth of said second ball;

said second truncate neck having a length insufficient to enable said second ball to be inserted into said second cavity;

said second truncate neck having a length sufficient to receive a second plurality of strung beads thereon, each strung bead of said second plurality of string beads having a bore formed therein, and each of said bores having a uniform diameter slightly greater than said uniform diameter of said second truncate neck;

said first spherical body being formed of a flexible and resilient material so that said first opening momentarily enlarges to admit said second ball of said second spherical body into said first cavity of said first spherical body when said second ball is pressed thereinto and said first opening returning to said initial breadth to capture said second ball in said first cavity after said second ball has passed through said first opening;

said second spherical body being formed of a flexible and resilient material so that said second opening momentarily enlarges to admit a third ball of a third spherical body into said second cavity of said second spherical body when said third ball is pressed thereinto and said second opening returning to said initial breadth to capture said third ball in said second cavity after said third ball has passed through said second opening;

an annular jewelry item being formed when a plurality of said pop beads are chained together.

* * * * *